US011415931B2

(12) United States Patent
Ikegami et al.

(10) Patent No.: US 11,415,931 B2
(45) Date of Patent: Aug. 16, 2022

(54) IMAGE FORMING APPARATUS HAVING DETACHABLE FIXING DEVICE

(71) Applicant: BROTHER KOGYO KABUSHIKI KAISHA, Nagoya (JP)

(72) Inventors: Yusuke Ikegami, Nagoya (JP); Yuichiro Ichinose, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/385,268

(22) Filed: Jul. 26, 2021

(65) Prior Publication Data

US 2022/0035306 A1 Feb. 3, 2022

(30) Foreign Application Priority Data

Jul. 29, 2020 (JP) ..... JP2020-127872

(51) Int. Cl.
*G03G 21/00* (2006.01)
*G03G 21/16* (2006.01)

(52) U.S. Cl.
CPC ..... *G03G 21/1685* (2013.01); *G03G 21/1633* (2013.01); *G03G 2221/1639* (2013.01); *G03G 2221/1687* (2013.01)

(58) Field of Classification Search
CPC ..... G03G 21/1685; G03G 21/1633; G03G 2221/1687; G03G 2221/1639
USPC ..... 399/122
See application file for complete search history.

(56) References Cited

U.S. PATENT DOCUMENTS 7,269,379 B2 * 9/2007 Nakanishi ..... G03G 21/1638 399/125
2001/0036377 A1 * 11/2001 Tsujihara ..... G03G 21/1685 399/323
2006/0018672 A1 * 1/2006 Asaba ..... G03G 15/70 399/21
2007/0052151 A1 * 3/2007 Asaba ..... G03G 21/1638 271/10.01
2009/0060573 A1 3/2009 Ito
2011/0001284 A1 * 1/2011 Ohtsuki ..... G03G 21/1633 271/162
2011/0044704 A1 * 2/2011 Uehara ..... G03G 21/1633 399/21

FOREIGN PATENT DOCUMENTS

JP 2009-63749 A 3/2009
JP 2015-107871 A 6/2015

* cited by examiner

*Primary Examiner* — Robert B Beatty
(74) *Attorney, Agent, or Firm* — Merchant & Gould P.C.

(57) ABSTRACT

A branch frame has a first guide surface and a second guide surface. In a state where a first cover is located at an open position, at least part of the first cover is located in a space through which a fixing device passes when the fixing device is detached from a mount portion, and the fixing device is unattachable to and undetachable from the mount portion through a first opening. In a state where the branch frame is attached to a main housing, at least part of the branch frame is located in the space, and the fixing device is unattachable to and undetachable from the mount portion through the first opening. In a state where the first cover and the branch frame are detached from the main housing, the fixing device is attachable to and detachable from the mount portion through the first opening.

16 Claims, 12 Drawing Sheets

IMAGE FORMING APPARATUS HAVING DETACHABLE FIXING DEVICE

CROSS REFERENCE TO RELATED APPLICATIONS

This application claims priority from Japanese Patent Application No. 2020-127872 filed Jul. 29, 2020. The entire content of the priority application is incorporated herein by reference.

TECHNICAL FIELD

This disclosure relates to an image forming apparatus.

BACKGROUND

Conventionally, there is a known image forming apparatus capable of performing duplex printing by inverting the front and back sides of a sheet. This image forming apparatus includes a branch frame for branching a discharge path for discharging the sheet to the outside of the apparatus and a reversing path for reversing the sheet.

Further, there is a known image forming apparatus in which an inner chute and a sub chute constituting a sheet conveyance path are detachable in order to facilitate replacement of a fixing device. In this image forming apparatus, the sub chute is attached to the top cover, and the inner chute can be easily attached and detached by removing the sub chute.

SUMMARY

According to one aspect, this specification discloses an image forming apparatus. The image forming apparatus includes a main housing, a first cover, a print engine, a fixing device, and a branch frame. The main housing has a first opening and a mount portion. The first cover is attachable to and detachable from the main housing. The first cover is rotationally movable between a closed position at which the first cover closes the first opening and an open position at which the first cover opens the first opening. The print engine is configured to form an image on a sheet. A first path, a second path, and a third path are formed in the main housing for performing duplex printing by inverting a front side and a back side of a sheet. The first path guides a sheet conveyed from the print engine to outside the main housing. The second path branches from the first path and guides a sheet conveyed from the print engine. The third path is connected to the first path and the second path and guides a sheet on which an image is formed to the print engine again. The fixing device is attachable to and detachable from the mount portion through the first opening. The branch frame is attachable to and detachable from the main housing. At least part of the branch frame is located between the fixing device and the first cover. The branch frame has a first guide surface forming the first path and a second guide surface forming the second path. In a state where the first cover is located at the open position, at least part of the first cover is located in a space through which the fixing device passes when the fixing device is detached from the mount portion, and the fixing device is unattachable to and undetachable from the mount portion through the first opening. In a state where the branch frame is attached to the main housing, at least part of the branch frame is located in the space, and the fixing device is unattachable to and undetachable from the mount portion through the first opening. In a state where the first cover and the branch frame are detached from the main housing, the fixing device is attachable to and detachable from the mount portion through the first opening.

BRIEF DESCRIPTION OF THE DRAWINGS

Embodiments in accordance with this disclosure will be described in detail with reference to the following figures wherein.

DETAILED DESCRIPTION

Figure 1:
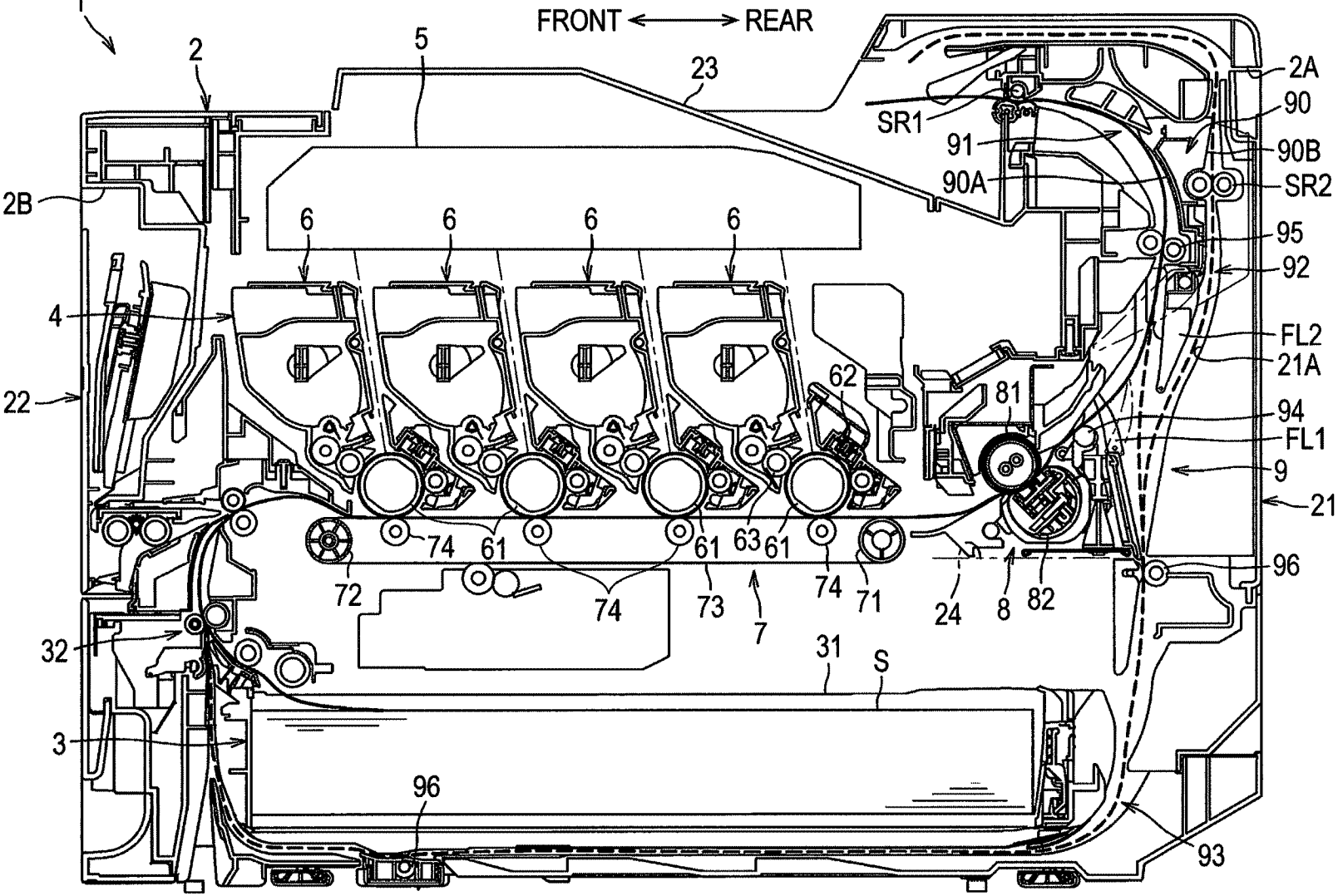
FIG. 1 is a diagram showing an image forming apparatus according to one embodiment.

In an image forming apparatus having a branch frame, there is a problem that the branch frame gets in the way and a fixing device cannot be easily attached and detached.

In view of the foregoing, an aspect of an objective of this disclosure is to facilitate attachment and detachment of a fixing device in an image forming apparatus having a branch frame.

Hereinafter, an embodiment of this disclosure will be described in detail with reference to the drawings as appropriate. In the following description, the directions will be defined as viewed from the user who uses an image forming apparatus 1. That is, in FIG. 1, the left in the drawing surface is referred to as "front", and the right in the drawing surface is referred to as "rear". Further, the axial direction of a photosensitive drum 61 is referred to as "axial direction".

As shown in FIG. 1, the image forming apparatus 1 is a color printer, and is configured to perform duplex printing by inverting the front and back sides of a sheet S. The image forming apparatus 1 includes a main housing 2, and a supply unit 3, an image forming unit 4, and a conveyance unit 9 arranged inside the main housing 2. The image forming unit 4 includes a fixing device 8.

Figure 2:
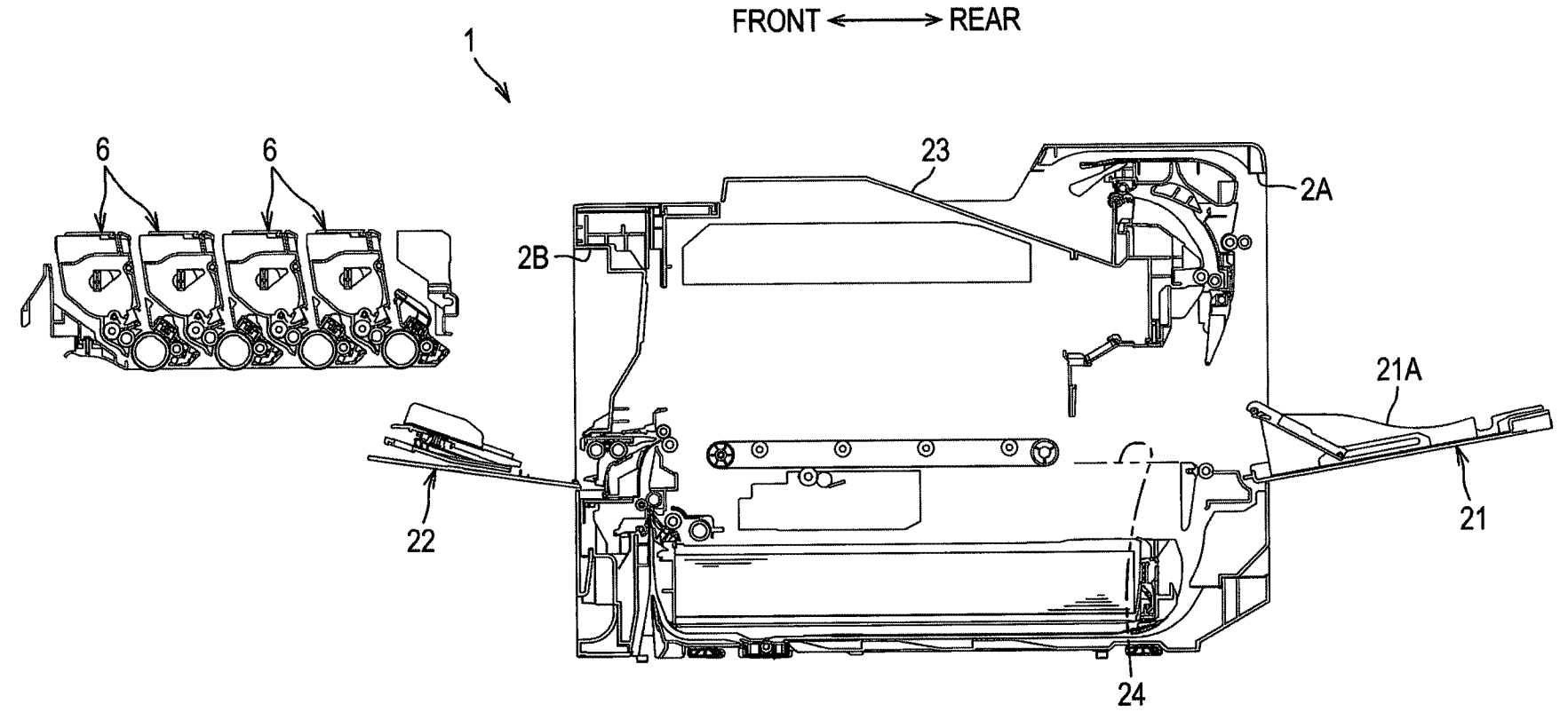
FIG. 2 is a diagram illustrating positions of a first cover and a second cover.

As shown in FIG. 2, the main housing 2 has a first opening 2A, a second opening 2B, a first cover 21, a second cover 22, a discharge tray 23, and a mount portion 24.

The first cover 21 is provided at the rear side of the main housing 2. The first cover 21 is rotationally movable between a closed position at which the first cover 21 covers the first opening 2A (see FIG. 1) and an open position at which the first cover 21 opens the first opening 2A (see FIG. 2). Further, as will be described in detail later, the first cover 21 is attachable to and detachable from the main housing 2.

Figures 3A, 3B:
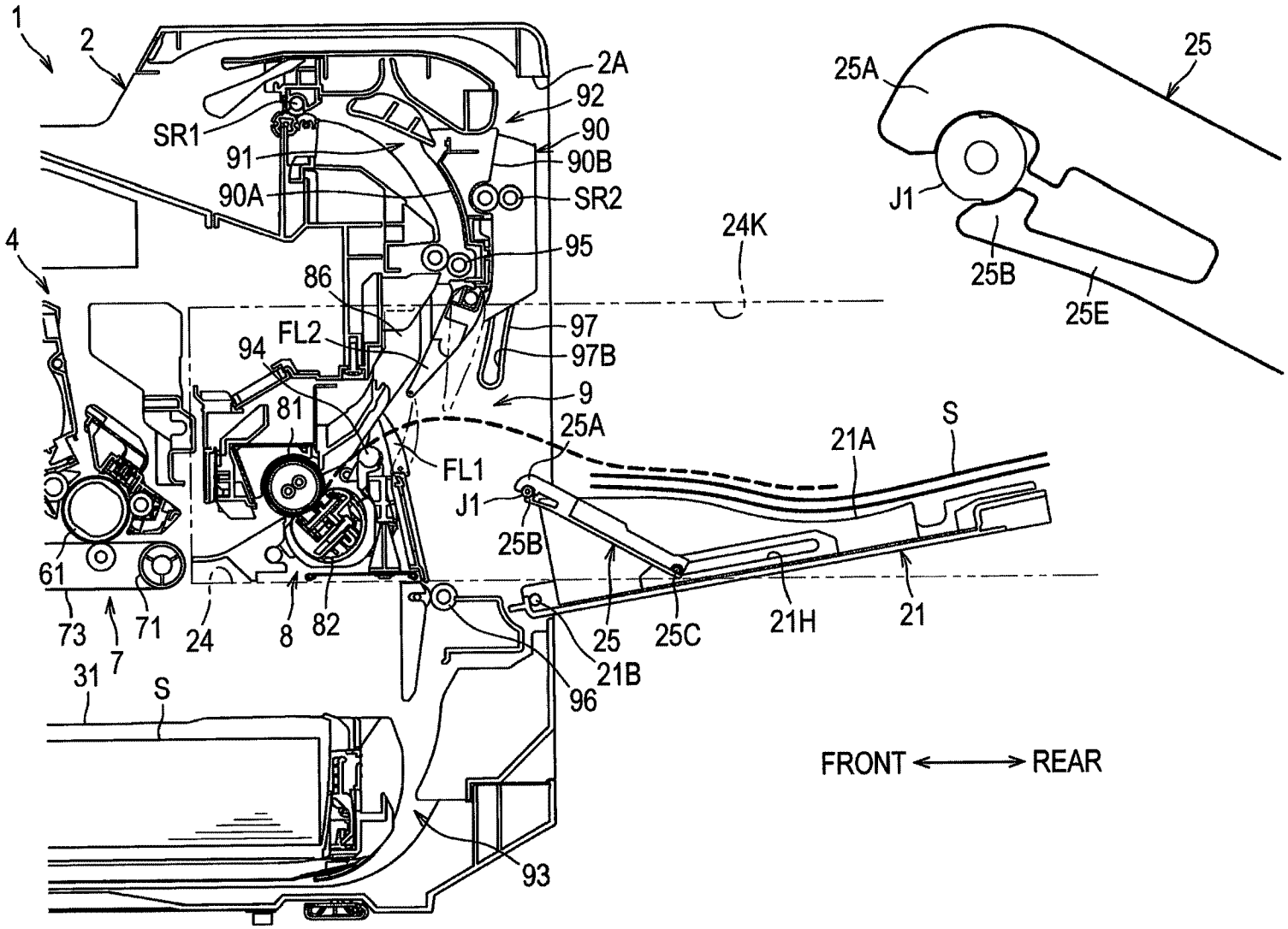
FIG. 3A is a diagram showing the first cover located at an open position.
FIG. 3B is an enlarged view of one end of a first rotational-movement restricting member.

As shown in FIG. 3A, the first cover 21 has a third guide surface 21A. The third guide surface 21A faces forward in a state where the first cover 21 is located at the closed position (see FIG. 1), and faces upward in a state where the first cover 21 is located at the open position. In a state where the first cover 21 is located at the open position, the third guide surface 21A supports the sheet S conveyed from the fixing device 8. When the first cover 21 is moved to the open position, a controller (not shown) of the image forming apparatus 1 controls a second flapper FL2 described later to move to a second position (the position shown by the solid line in FIG. 3A). With this operation, the sheet S that has passed through the fixing device 8 is placed on the third guide surface 21A without being interfered by the second flapper FL2.

As shown in FIG. 2, the second cover 22 is provided at the front side of the main housing 2. That is, the second cover 22 is provided at the surface of the main housing 2 opposite the first cover 21. The second cover 22 is rotationally movable between a closed position at which the second cover 22 covers a second opening 2B (see FIG. 1) and an open position at which the second cover 22 opens the second opening 2B (see FIG. 2). When the second cover 22 is located at the open position, the user can attach and detach a process unit 6 described later through the second opening 2B.

The discharge tray 23 is provided at the upper surface of the main housing 2. The discharge tray 23 supports the sheet S discharged to the outside of the main housing 2.

The mount portion 24 is a space in which the fixing device 8 is mounted, and is located closer to the first opening 2A than to the second opening 2B. The fixing device 8 is attachable to and detachable from the mount portion 24 through the first opening 2A.

As shown in FIG. 1, the supply unit 3 is provided in the lower part of the main housing 2. The supply unit 3 includes a supply tray 31 and a supply mechanism 32. The supply tray 31 stores a sheet S. The supply mechanism 32 supplies the sheet S in the supply tray 31 and the sheet S having been guided in a third path 93 described later to the image forming unit 4.

The image forming unit 4 has a function of transferring a toner image to a sheet S to form an image. The image forming unit 4 includes an exposure device 5, four process units 6, a transfer unit 7, and the fixing device 8.

The exposure device 5 is arranged in the upper part of the main housing 2. The exposure device 5 includes a light source (not shown), a polygon mirror, and so on. The exposure device 5 exposes the surface of the photosensitive drum 61 by scanning the surface of the photosensitive drum 61 at high speed with a light beam indicated by the single-dot chain line.

The process units 6 are arranged between the exposure device 5 and the supply tray 31. The process unit 6 includes the photosensitive drum 61, a charger 62, and a development roller 63. In the four process units 6, toner of each color of yellow, magenta, cyan, and black is contained. The process unit 6 is an example of a print engine.

The transfer unit 7 is arranged between the process units 6 and the supply tray 31. The transfer unit 7 includes a drive roller 71, a follow roller 72, a conveyance belt 73, and four transfer rollers 74. The conveyance belt 73 is an endless belt, and is stretched between the drive roller 71 and the follow roller 72. Inside the conveyance belt 73, the transfer rollers 74 are arranged so as to sandwich the conveyance belt 73 with the corresponding photosensitive drums 61.

The charger 62 charges the surface of the photosensitive drum 61. After that, the exposure device 5 exposes the surface of the photosensitive drum 61 to form an electrostatic latent image based on image data on the surface of the photosensitive drum 61. The development roller 63 supplies toner to the electrostatic latent image formed on the photosensitive drum 61. As a result, a toner image is formed on the photosensitive drum 61. After that, when the sheet S is conveyed between the photosensitive drum 61 and the transfer roller 74 by the conveyance belt 73, the toner image on the photosensitive drum 61 is transferred to the sheet S.

The fixing device 8 is a device for thermally fixing a toner image on the sheet S. The fixing device 8 is arranged at the rear side of the process unit 6 and the transfer unit 7. The fixing device 8 includes a heat roller 81, a pressure member 82 that sandwiches the sheet S with the heat rollers 81, and a first flapper FL1.

The first flapper FL1 is swingable between a third position indicated by the double-dot chain line and a fourth position indicated by the solid line. When the first flapper FL1 is located at the third position, the first flapper FL1 guides the sheet S conveyed from the image forming unit 4 toward the conveyance unit 9. When the first flapper FL1 is located at the fourth position, the first flapper FL1 prevents the sheet S having been sent to the conveyance unit 9 from returning to the fixing device 8.

The first flapper FL1 is urged toward the fourth position by a spring (not shown). When the sheet S conveyed from the image forming unit 4 pushes the first flapper FL1 against the urging force of the spring, the first flapper FL1 swings from the fourth position to the third position. Then, when the trailing end of the sheet S separates from the first flapper FL1, the first flapper FL1 swings from the third position to the fourth position due to the urging force of the spring.

Figure 4A:
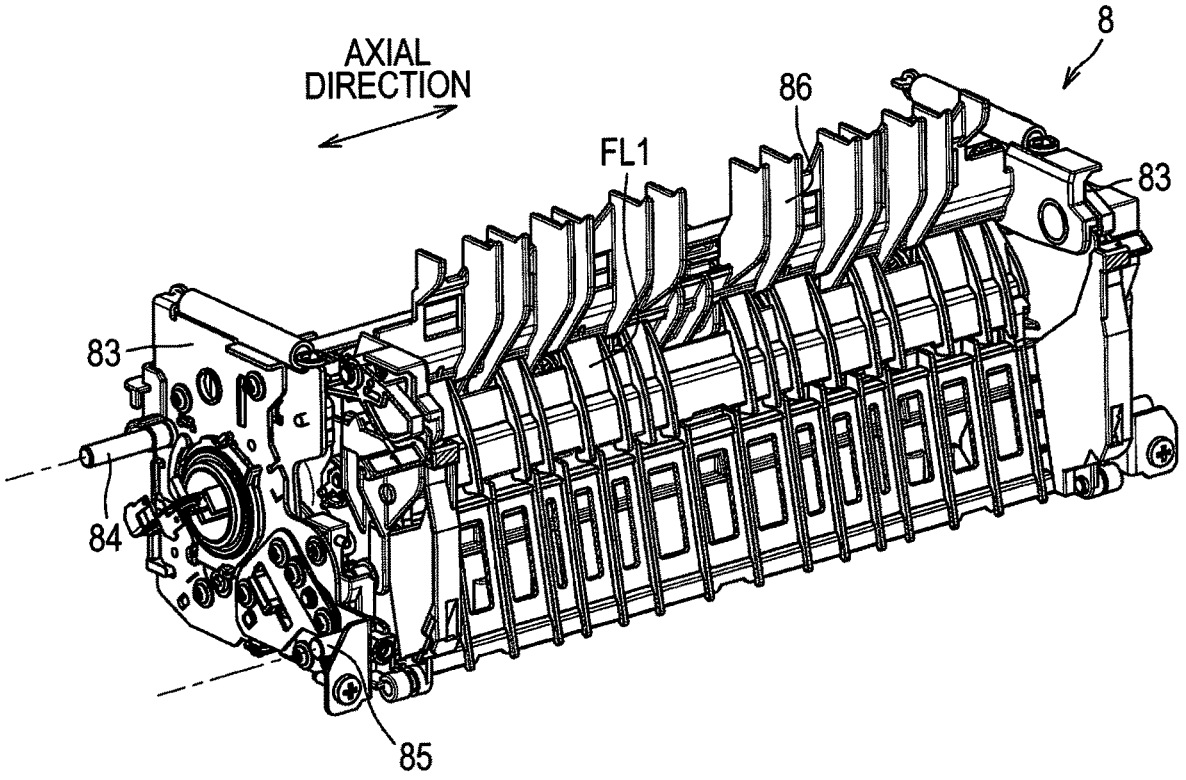
FIG. 4A is a perspective view of a fixing device viewed from the rear side.

As shown in FIG. 4A, the fixing device 8 further includes fixing side frames 83, a first shaft 84, a second shaft 85, and a chute 86. The fixing side frames 83 are provided at both ends of the fixing device 8 in the axial direction. The first shaft 84 and the second shaft 85 are also provided at both sides of the fixing device 8 in the left-right direction and symmetrical to each other in the left-right direction. The first shaft 84 and the second shaft 85 protrude outward in the axial direction from the fixing side frames 83. The chute 86 is located at a rear portion of the fixing device 8 and extends upward. The chute 86 is used for guiding the sheet S having been sent from the fixing device 8 toward the second flapper FL2. The chute 86 of the fixing device 8 extends to a higher position than a first protrusion 90C and a second protrusion 90D which function as the rotation axis of a branch frame 90 (see FIG. 8).

The second shaft 85 is located at a position lower than the first shaft 84 and farther rearward than the first shaft 84. The protrusion amount of the second shaft 85 is smaller than the protrusion amount of the first shaft 84.

Figure 4B:
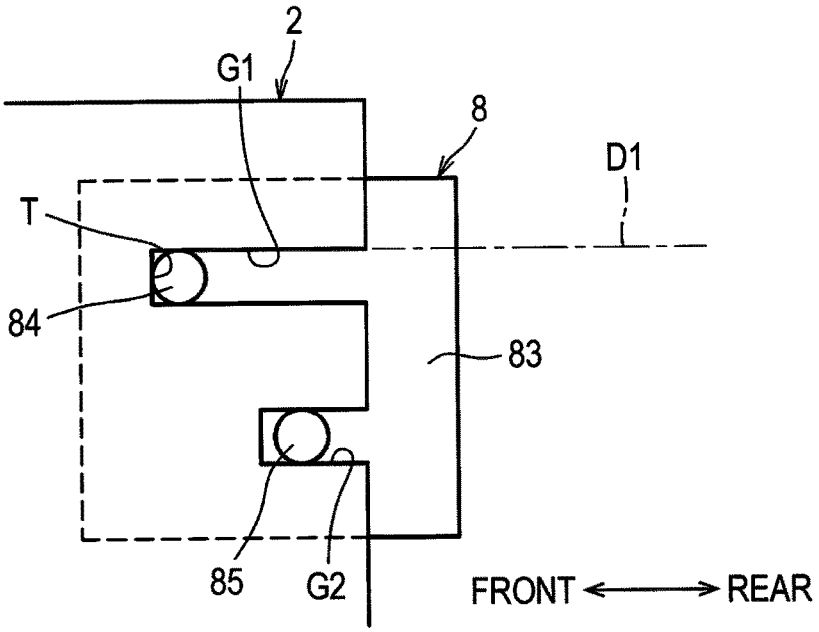
FIG. 4B is an explanatory diagram for illustrating a state where the fixing device is positioned relative to a main housing.

As shown in FIG. 4B, the main housing 2 includes a first groove G1 in which the first shaft 84 is slidable, and a second groove G2 in which the second shaft 85 is slidable. The first groove G1 and the second groove G2 extend linearly in the front-rear direction and are parallel to each other. In a state where the fixing device 8 is attached to the main housing 2, the position of the first shaft 84 is defined in the first groove G1 due to contact of the first shaft 84 with a bottom (end) T of the first groove G1, and the second groove G2 engages the second shaft 85 to define the orientation of the fixing device 8. In this way, the position of the fixing device 8 in the front-rear direction is determined by the first groove G1 and the first shaft 84, and the position of the fixing device 8 in the vertical direction is determined by the first groove G1, the second groove G2, the first shaft 84, and the second shaft 85. Because the first shaft 84 is slidable relative to the first groove G1 and the second shaft 85 is slidable relative to the second groove G2, the fixing device 8 is attachable to and detachable from the main housing 2 in a direction D1 along which the first groove G1 extends.

Figure 6:
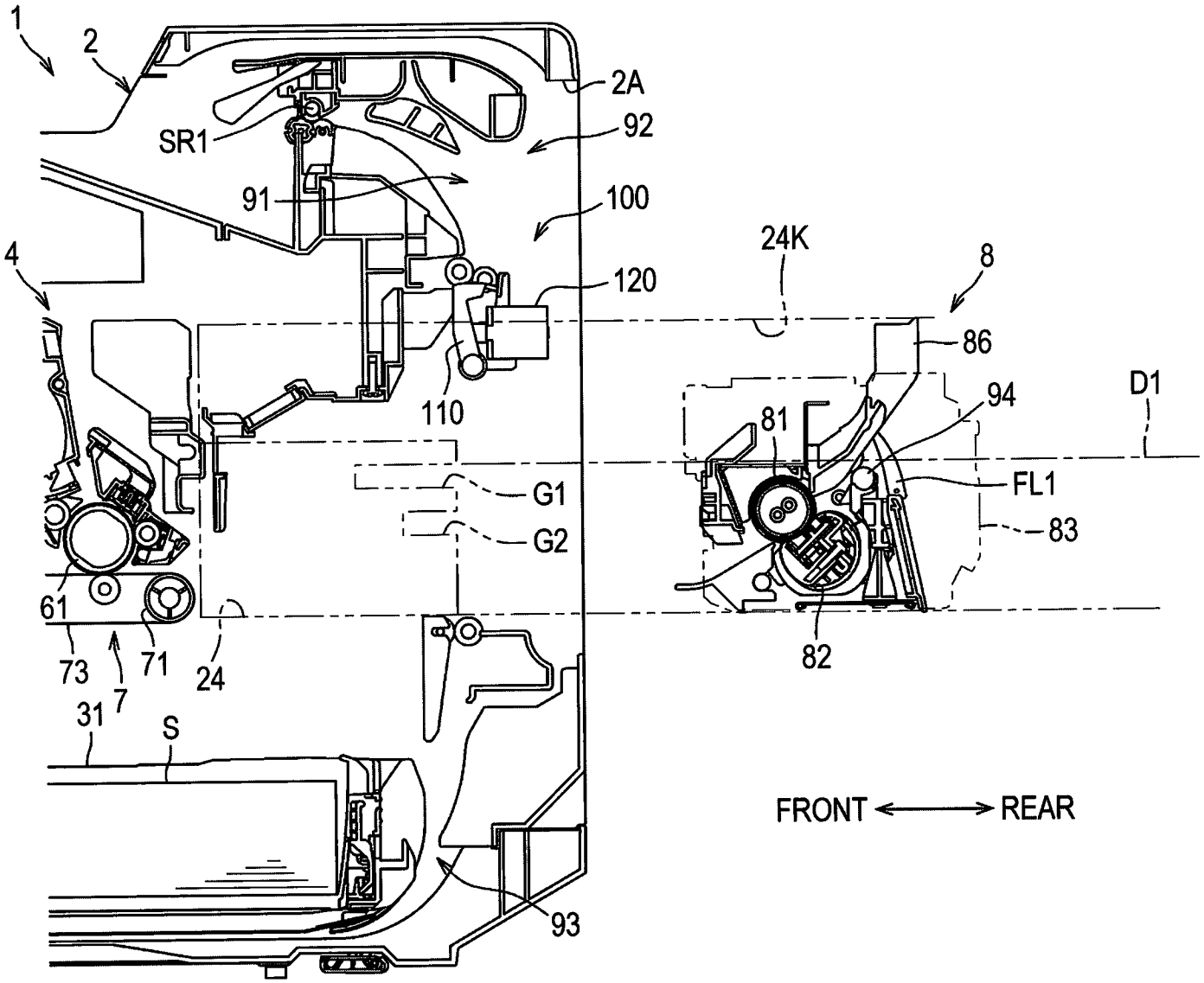
FIG. 6 is a diagram showing a state where the fixing device is detached from the main housing.

As shown in FIG. 1, the first cover 21 located at the close position and the fixing device 8 overlap each other as viewed from the direction D1. As shown in FIGS. 3A and 6, the first cover 21 located at the open position and the fixing device 8 overlap each other as viewed from the direction D1. In a state where the first cover 21 is located at the open position, at least part of the first cover 21 is located in a space 24K through which the fixing device 8 passes when the fixing device 8 is detached from the mount portion 24. This prohibits attachment and detachment of the fixing device 8 relative to the mount portion 24 through the first opening 2A in a state where the first cover 21 is located at the open position. Thus, in the image forming apparatus 1, regardless of whether the first cover 21 is located at the close position or at the open position, the fixing device 8 cannot be attached or detached through the first opening 2A unless the first cover 21 is detached.

Figure 8:
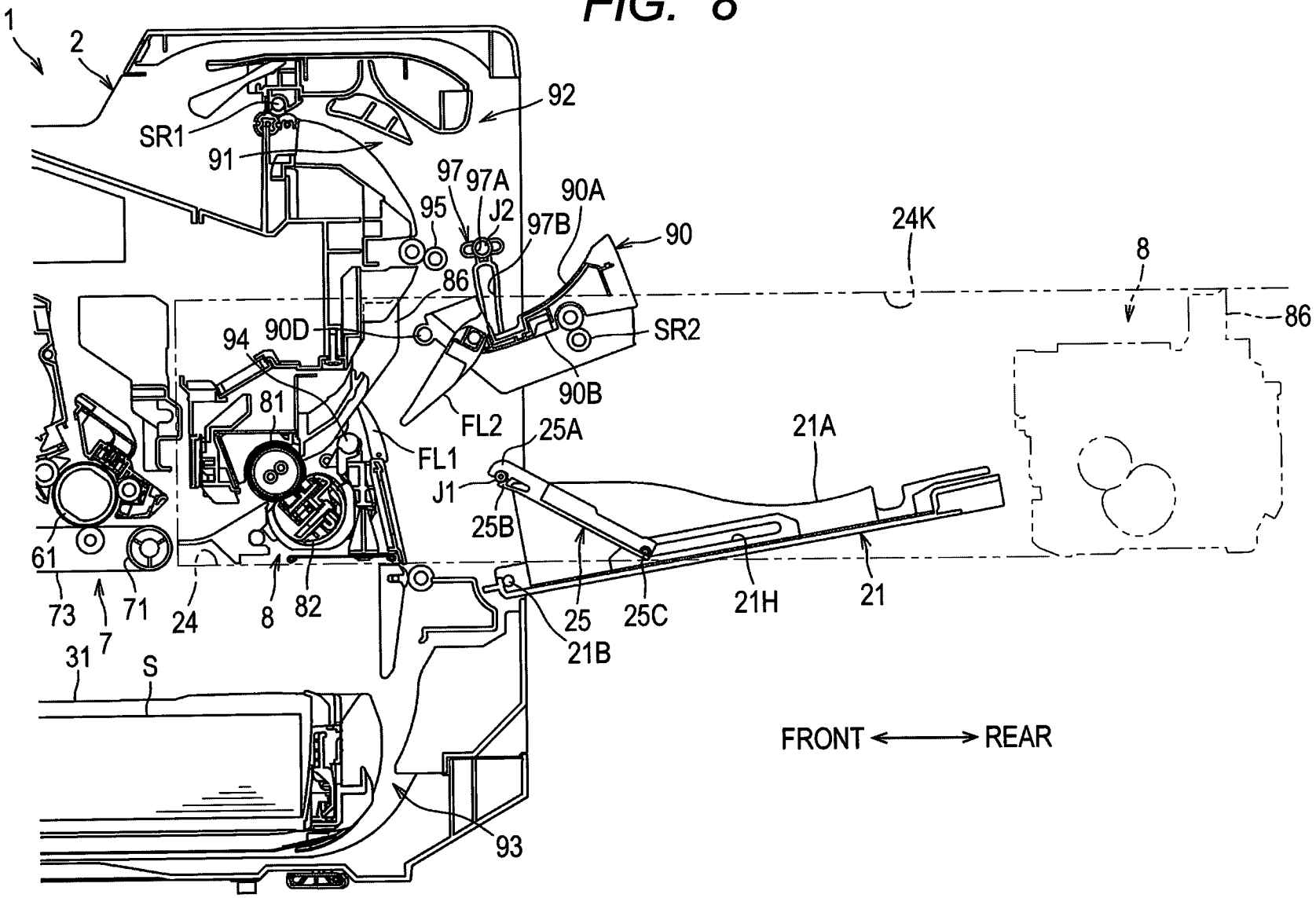
FIG. 8 is a diagram showing a state where a branch frame is located at an open position.

As shown in FIGS. 3A and 6, the branch frame 90 located at a normal position and the fixing device 8 overlap each other as viewed from the direction D1. As shown in FIG. 8, the branch frame 90 located at an open position and the fixing device 8 overlap each other as viewed from the direction D1. In a state where the branch frame 90 is attached to the main housing 2, at least part of the branch frame 90 is located in the space 24K through which the fixing device 8 passes when the fixing device 8 is detached from the mount portion 24. Thus, in the image forming apparatus 1, regardless of whether the branch frame 90 is located at the normal position or at the open position, the fixing device 8 cannot be attached to or detached from the mount portion 24 through the first opening 2A unless the branch frame 90 is detached from the main housing 2. In order to detach the fixing device 8, it is necessary to detach the branch frame 90 and open the space 24K for the chute 86 to pass through.

As shown in FIG. 6, in a state where the first cover 21 and the branch frame 90 are detached from the main housing 2, the fixing device 8 is attachable to and detachable from the mount portion 24 through the first opening 2A.

The conveyance unit 9 is configured to convey the sheet S that is conveyed from the image forming unit 4 toward the outside of the main housing 2 or toward the image forming unit 4 again. The conveyance unit 9 includes the branch frame 90, a first path 91, a second path 92, a third path 93, a first conveyance roller 94, a second conveyance roller 95, a first switchback roller SR1, and a plurality of re-conveyance rollers 96.

The branch frame 90 is provided at a rear portion of the main housing 2 and above the fixing device 8. The branch frame 90 is attachable to and detachable from the main housing 2 as described later in detail. At least part of the branch frame 90 is provided between the fixing device 8 and the first cover 21. The branch frame 90 is a frame for forming a branch into the first path 91 and the second path 92. More specifically, the branch frame 90 includes a first guide surface 90A forming the first path 91 and a second guide surface 90B forming the second path 92. The branch frame 90 includes a second switchback roller SR2 and the second flapper FL2 as an example of a guide member. The second switchback roller SR2 is located at an upper portion of the branch frame 90 and at the second guide surface 90B side. In other words, the second switchback roller SR2 is located on the second path 92.

The second flapper FL2 is provided at a lower portion of the branch frame 90. The second flapper FL2 is a member for guiding the sheet S that is conveyed from the image forming unit 4 toward the first path 91 or the second path 92. More specifically, the second flapper FL2 is movable between a first position (a position indicated by solid lines in FIG. 1) at which the sheet S conveyed from the image forming unit 4 is guided to the first path 91 and a second position (a position indicated by double-dot chain lines in FIG. 1) at which the sheet S conveyed from the image forming unit 4 is guided to the second path 92.

The image forming apparatus 1 includes a drive mechanism 100 that makes the second flapper FL2 movable between the first position and the second position. As shown in FIG. 6, the drive mechanism 100 is attached to the main housing 2.

Figure 7B:
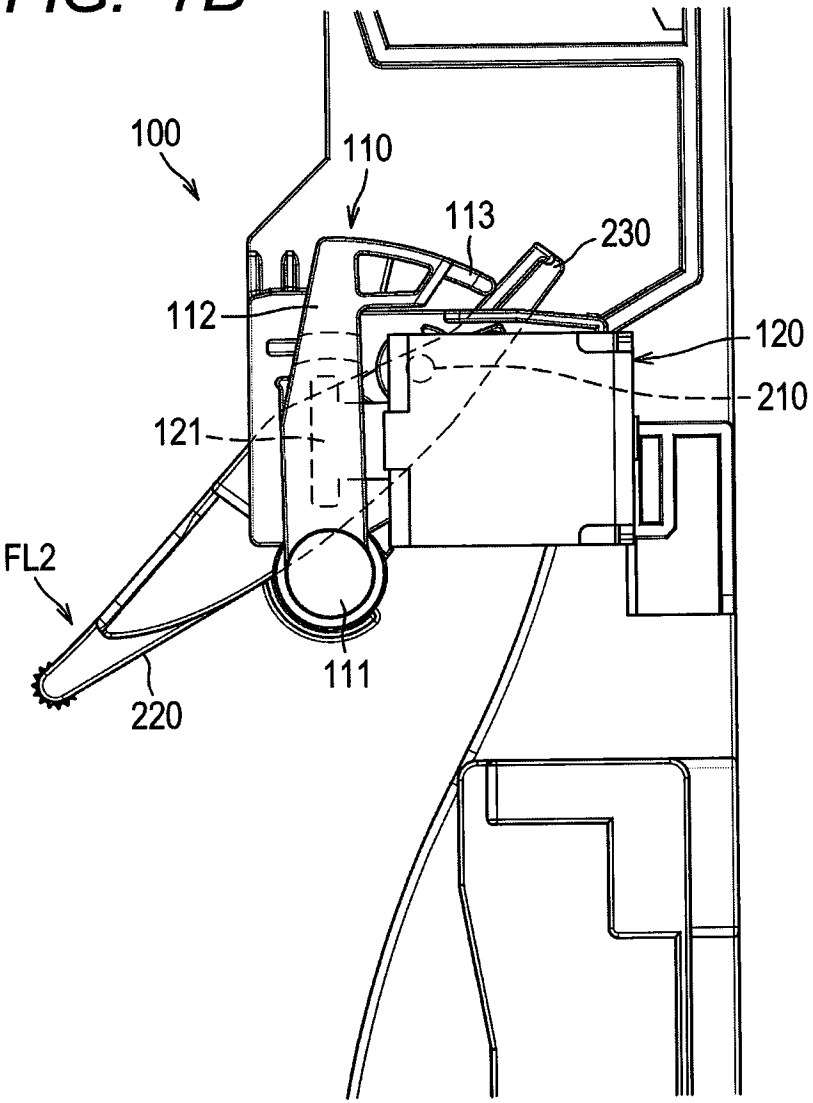
FIG. 7B is a diagram showing the second flapper located at a second position.
Figure 7A:
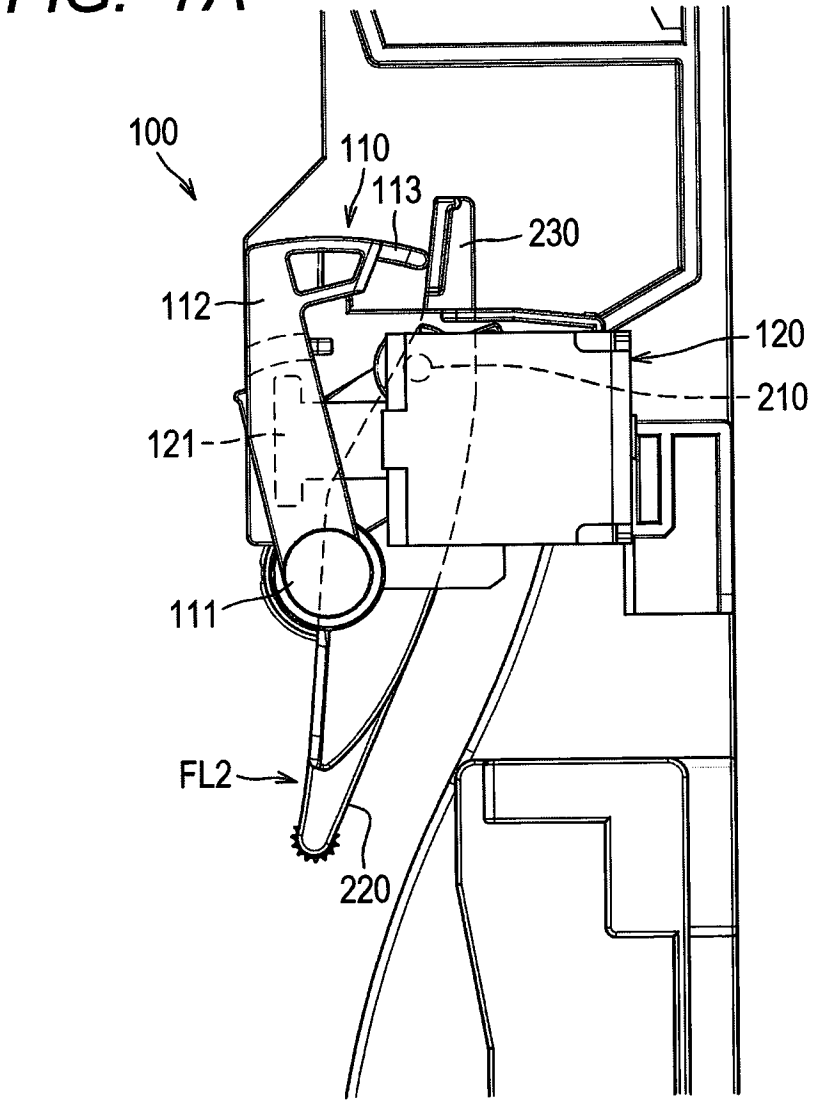
FIG. 7A is a diagram showing a second flapper located at a first position.

As shown in FIGS. 7A and 7B, the drive mechanism 100 includes a drive lever 110 as a member for moving the second flapper FL2, and an electromagnetic solenoid 120 for moving the drive lever 110. The second flapper FL2 includes a shaft 210, a flapper body 220 for guiding the sheet S, and an operation lever 230.

The drive lever 110 includes a shaft 111 supported so as to be rotatable relative to the main housing 2, a first arm 112 extending upward from the shaft 111, and a second arm 113 extending rearward from a tip of the first arm 112. The drive lever 110 is configured to swing about the shaft 111 between a fifth position shown in FIG. 7A and a sixth position shown in FIG. 7B.

The electromagnetic solenoid 120 includes a plunger 121. The plunger 121 has an end connected to the first arm 112.

As shown in FIG. 7B, as the electromagnetic solenoid 120 is energized to turn on, the plunger 121 pulls the first arm 112 to swingably move the drive lever 110 from the fifth position to the sixth position. By doing so, the operation lever 230 of the second flapper FL2 is pushed by the second arm 113 to move the second flapper FL2 from the first position to the second position.

As shown in FIG. 7A, as the energization of the electromagnetic solenoid 120 is stopped to turn off, the plunger 121 pushes the second arm 113 to swingably move the drive lever 110 from the sixth position to the fifth position. By doing so, the operation lever 230 of the second flapper FL2 is not pushed by the second arm 113, so that the second flapper FL2 moves from the first position to the second position due to gravity.

As shown in FIG. 1, the first path 91 is a path along which the sheet S conveyed from the image forming unit 4 is guided toward the discharge tray 23 outside the main housing 2. The first path 91 extends upward from a position near the first conveyance roller 94, curves frontward, and extends toward the discharge tray 23 outside the main housing 2. As described above, a part of the first path 91 is formed by the first guide surface 90A of the branch frame 90.

The second path 92 is a path branching from the first path 91 and used for guiding the sheet S conveyed from the image forming unit 4 toward the discharge tray 23 along a route different from the first path 91. The second path 92 branches from the first path 91 at a position near the second flapper FL2, extends upward while passing on the rear side of the first path 91, curves frontward, and extends toward the discharge tray 23 while passing over the first path 91. The second path 92 is provided at a position closer to the outside of the main housing 2 than the first path 91 is. As described above, a part of the second path 92 is formed by the second guide surface 90B of the branch frame 90. In a state where the first cover 21 is located at the close position, the third guide surface 21A of the first cover 21 forms the second path 92. That is, a part of the second path 92 is formed by the third guide surface 21A of the first cover 21.

The third path 93 is a path used for guiding the sheet S toward the image forming unit 4 again after the sheet S is pulled into the main housing 2 by the first switchback roller SR1 described later, and so on. The third path 93 is connected to the first path 91 and the second path 92. More specifically, the third path 93 is used for guiding the sheet S to the supply mechanism 32 upstream of the image forming unit 4. The third path 93 extends downward from a position near the second flapper FL2, curves frontward, then extends frontward while passing under the supply tray 31, is bent upward at the front of the supply tray 31, and extends toward the supply mechanism 32.

The first conveyance roller 94 is provided at the fixing device 8. The first conveyance roller 94 conveys the sheet S on which a toner image is thermally fixed toward the second flapper FL2.

The second conveyance roller 95 and the first switchback roller SR1 are provided on the first path 91. The first switchback roller SR1 is arranged closer to the discharge tray 23 than the second conveyance roller 95 is, along the first path 91.

The second conveyance roller 95 and the first switchback roller SR1 convey the sheet S having been guided to the first path 91 toward the outside of the main housing 2, and convey the sheet S to the third path 93 for switching the front side and the back side of the sheet S during duplex printing. The second switchback roller SR2 conveys the sheet S having been guided to the second path 92, and conveys the sheet S to the third path 93 for switching the front side and the back side of the sheet S during duplex printing.

More specifically, the second conveyance roller 95, the first switchback roller SR1, and the second switchback roller SR2 are configured to rotate forward and reversely. The second conveyance roller 95 and the first switchback roller SR1 convey the sheet S having been guided to the first path 91 to the outside of the main housing 2, particularly, toward the discharge tray 23 during their forward rotations, and pull the sheet S into the main housing 2 to convey the sheet S to the third path 93 during their reverse rotations. The second switchback roller SR2 conveys the sheet S having been guided to the second path 92 toward the discharge tray 23 during its forward rotation, and pulls the sheet S into the main housing 2 to convey the sheet S to the third path 93 during its reverse rotation.

The re-conveyance rollers 96 are provided on the third path 93. The re-conveyance rollers 96 convey the sheet S on the third path 93 toward the supply mechanism 32.

A configuration for attaching and detaching the fixing device 8 to and from the main housing 2 will be described next.

As described above, in the image forming apparatus 1 of this embodiment, in order to attach and detach the fixing device 8 to and from the main housing 2, the first cover 21 needs to be detached from the main housing 2 and the branch frame 90 needs to be detached from the main housing 2. A configuration described first is for allowing the first cover 21 to rotationally move relative to the main housing 2 and allowing the first cover 21 to be attached to and detached from the main housing 2.

Figure 5A:
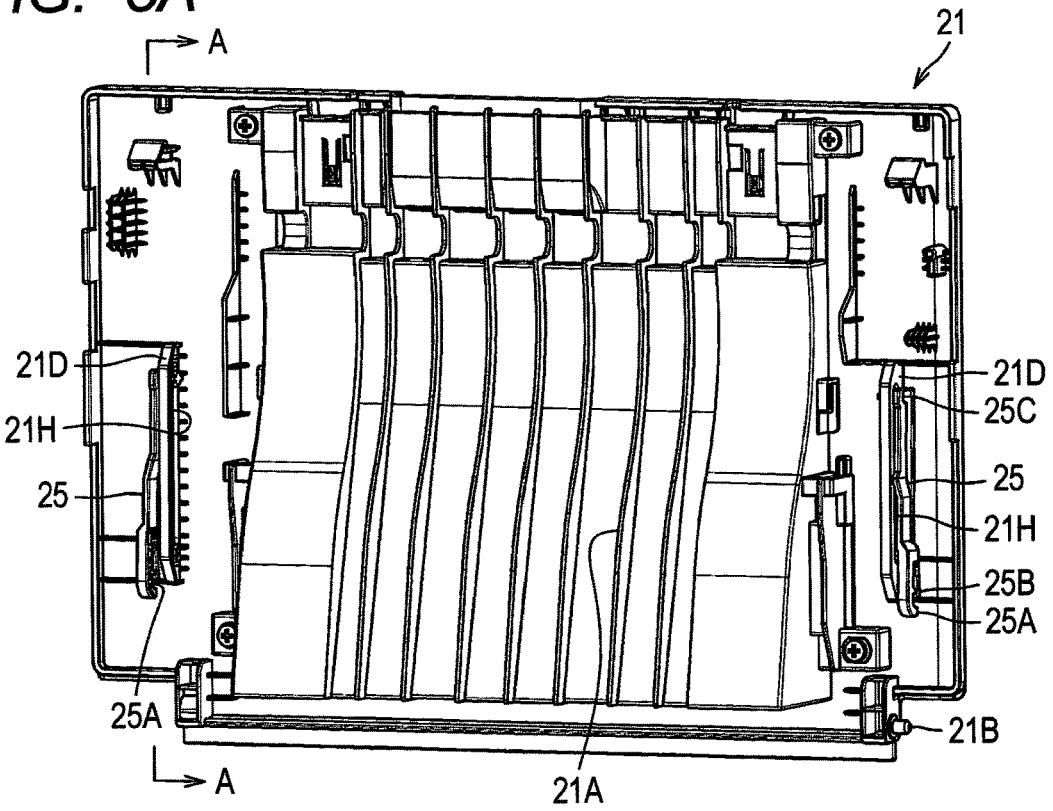
FIG. 5A is a perspective view of an inner surface of the first cover.
Figure 5B:
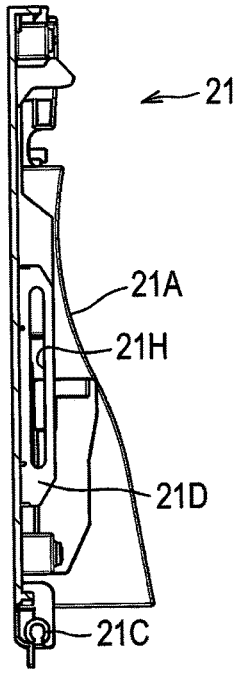
FIG. 5B is a cross-sectional view taken along a line A-A in FIG. 5A.

The first cover 21 is supported by a pivotal support mechanism at its lower end. The pivotal support mechanism is configured to rotationally move relative to the main housing 2 and is attachable to and detachable from the main housing 2 without using a tool. More specifically, as shown in FIGS. 5A and 5B, the first cover 21 includes a shaft 21B and a bearing 21C. By coupling the shaft 21B and the bearing 21C to the main housing 2, the first cover 21 is supported so as to be rotationally movable relative to the main housing 2.

The shaft 21B and the bearing 21C are provided so as to protrude in the axial direction from both ends of the first cover 21 in the axial direction. In a state where the first cover 21 is located at the close position, the shaft 21B and the bearing 21C are located at the lower end of the first cover 21.

More specifically, the shaft 21B has a circular columnar shape protruding in the axial direction from the first cover 21. The shaft 21B fits in a hole at the main housing 2 (not shown).

Figure 5C:
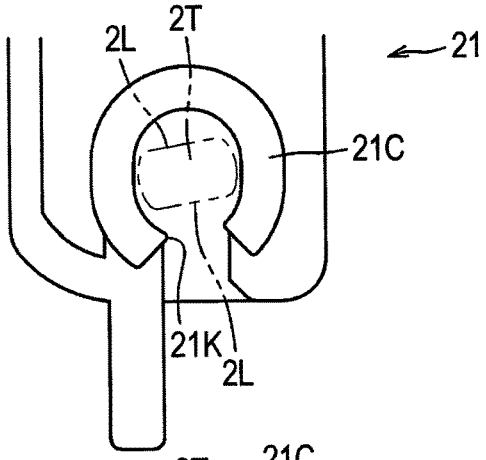
FIG. 5C is an enlarged view of a bearing of the first cover located at a closed position.
Figure 5D:
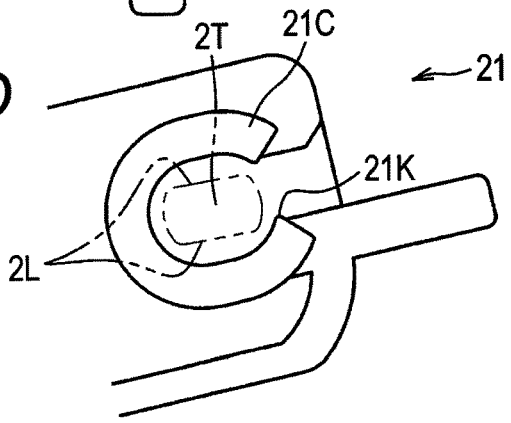
FIG. 5D is an enlarged view of the bearing of the first cover located at a release position.

As shown in FIG. 5C, the bearing 21C has a C-shape with an opening 21K. In a state where the first cover 21 is located at the close position, the opening 21K is opened downward. The bearing 21C is engaged with a shaft 2T formed at the main housing 2. The shaft 2T is a two-chamfer shaft prepared by forming a circular column into a shape with two planar portions 2L parallel to each other. As shown in FIG. 5C, when the lengthwise direction of the shaft 2T (the direction along the planar portions 2L as viewed from the axial direction) is directed to a different direction from the opening 21K, the bearing 21C does not separate from the shaft 2T but rotationally supports the first cover 21. As shown in FIG. 5D, when the lengthwise direction of the shaft 2T is directed to the opening 21K, the bearing 21C can separate from the shaft 2T along the lengthwise direction of the shaft 2T. The position of the first cover 21 in a state where the opening 21K is directed to the lengthwise direction of the shaft 2T is referred to as a release position. That is, when the first cover 21 is located at the release position, the first cover 21 is detachable from the main housing 2.

The pivotal support mechanism of coupling the lower end of the first cover 21 in a detachable manner to the main housing 2 may be configured such that the main housing 2 includes a bearing with an opening, and the first cover 21 includes a shaft to be coupled in a detachable manner to the bearing.

The first cover 21 includes two first rotational-movement restricting members 25 that prevent the first cover 21 from rotationally moving downward farther than the open position. More specifically, the first rotational-movement restricting members 25 prevent the first cover 21 from rotationally moving to the release position.

As shown in FIG. 5A, the two first rotational-movement restricting members 25 are provided at both ends of the first cover 21 in the axial direction.

The first cover 21 includes two slide coupling portions 21D provided at its both ends in the axial direction so as to correspond to the two first rotational-movement restricting members 25. The corresponding first rotational-movement restricting members 25 are coupled to the slide coupling portions 21D in a rotatable and slidable manner. The slide coupling portions 21D are located at both sides of the third guide surface 21A. Each of the slide coupling portions 21D protrudes like a rib and has an elongated hole 21H formed to penetrate the slide coupling portion 21D in the axial direction. In a state where the first cover 21 is at the close position, the elongated hole 21H extends in the vertical direction.

An upper end of the first rotational-movement restricting member 25 is coupled to the main housing 2 through a coupling portion which is attachable and detachable without using a tool. More specifically, as shown in FIG. 3B, the first rotational-movement restricting member 25 includes a pivotal support portion 25A and a lock portion 25B at its upper end, and an engagement portion 25C at its lower end (see FIG. 3A).

The pivotal support portion 25A has a recess to accept a shaft J1 provided at the main housing 2. The lock portion 25B is arranged to face the recess of the pivotal support portion 25A. The lock portion 25B is continuous with the body of the first rotational-movement restricting member 25 through an elongated arm 25E. The lock portion 25B is made movable relative to the pivotal support portion 25A by the deflection of the arm 25E. The shaft J1 of the main housing 2 is caught between the pivotal support portion 25A and the lock portion 25B to be coupled to the first rotational-movement restricting member 25, thereby rotationally supporting the first rotational-movement restricting member 25.

The engagement portion 25C has a shaft protruding in the axial direction. As shown in FIG. 3A, the engagement portion 25C is engaged with the elongated hole 21H of the first cover 21. With this configuration, the engagement portion 25C is coupled to the first cover 21 in a rotatable and slidable manner along the elongated hole 21H. The first rotational-movement restricting member 25 is made of a material having suitable elasticity, and functions as a damper to absorb shock occurring during opening and closing of the first cover 21.

The coupling portion for detachably coupling the upper end of the first rotational-movement restricting member 25 to the main housing 2 may be configured such that the main housing 2 includes a pivotal support portion, and the first rotational-movement restricting member 25 includes a shaft to be detachably coupled to the pivotal support portion.

A configuration for making the branch frame 90 attachable to and detachable from the main housing 2 will be described next.

As shown in FIG. 8, in a state where the first cover 21 is located at the open position, the branch frame 90 is configured to rotationally move between the normal position (see FIG. 3A) and the open position (see FIG. 8) for opening the first path 91 relative to the normal position. The open position is used for removing paper when a paper jam occurs at the first path 91. The branch frame 90 is supported by a pivotal support mechanism at its lower end. The pivotal support mechanism is configured to rotationally move relative to the main housing 2 and is attachable to and detachable from the main housing 2 without using a tool.

Figure 9A:
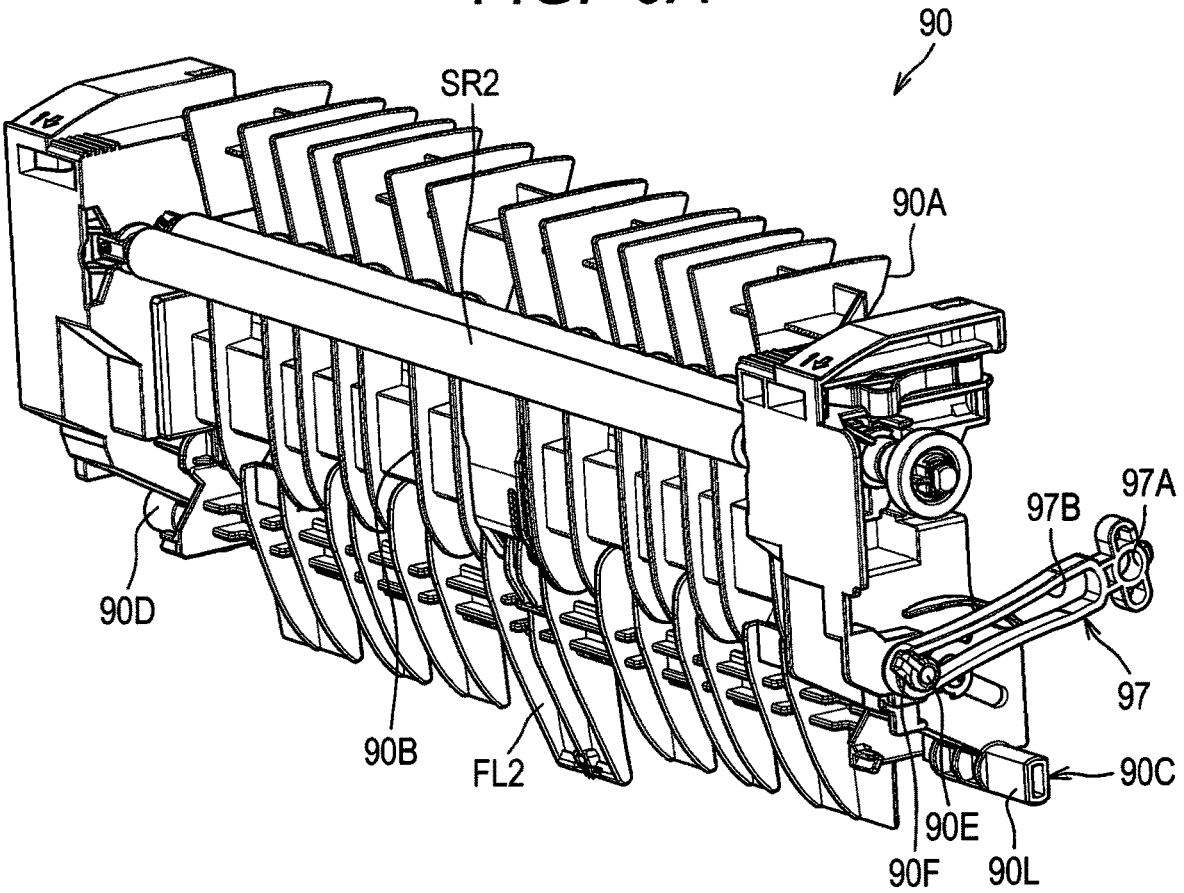
FIG. 9A is a perspective view of the branch frame viewed from the rear side.
Figure 9B:
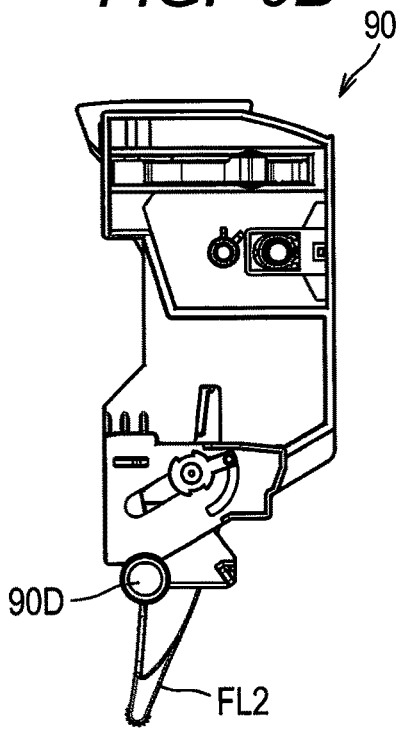
FIG. 9B is a diagram of a second protrusion of the branch frame as viewed from an axial direction.
Figure 10:
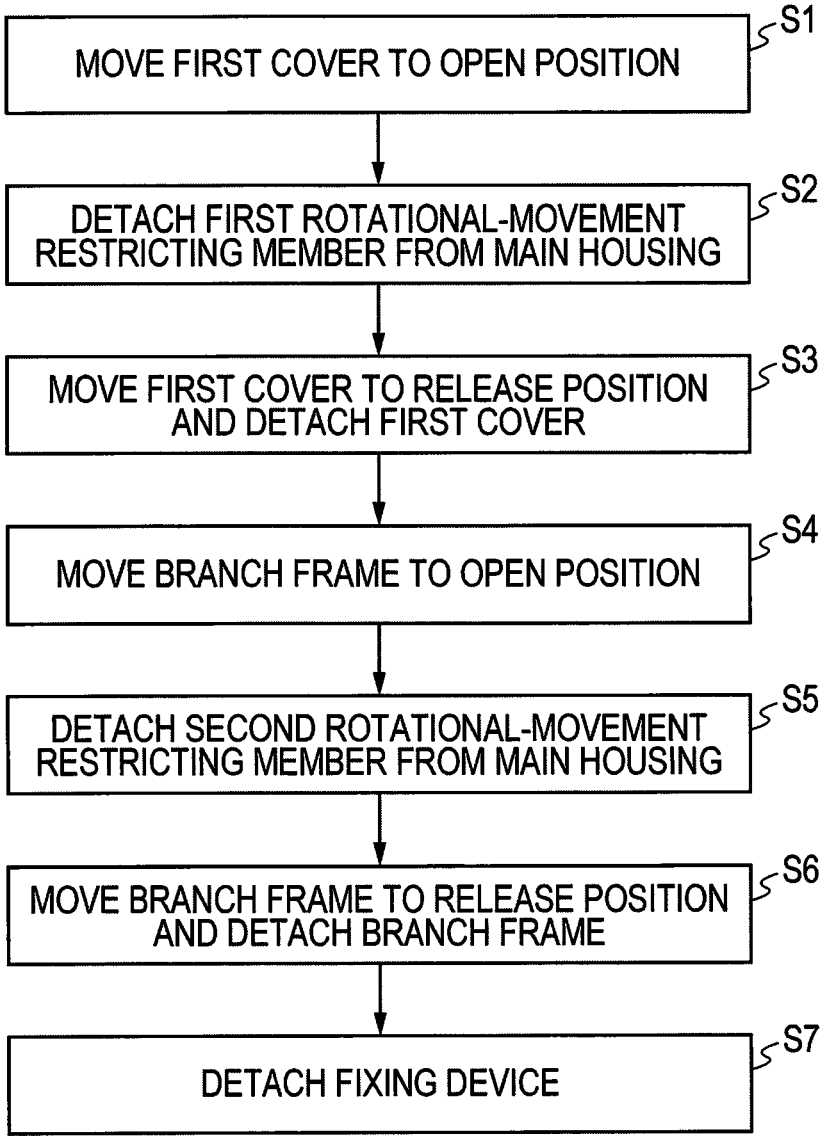
FIG. 10 is a flowchart showing a procedure for an operator to detach the fixing device from the main housing.

More specifically, as shown in FIG. 9, the branch frame 90 includes the first protrusion 90C, a second protrusion 90D, and a third protrusion 90E.

In a state where the branch frame 90 is located at the normal position, the first protrusion 90C and the second protrusion 90D are located at lower portions of the branch frame 90, which are at both ends of the branch frame 90 in the axial direction.

The first protrusion 90C protrudes in the axial direction. The first protrusion 90C is a two-chamfer shaft prepared by forming a circular column into a shape with two planar portions 90L parallel to each other. In a state where the branch frame 90 is located at the normal position, the first protrusion 90C extends in the vertical direction as viewed from the axial direction.

Figure 12A:
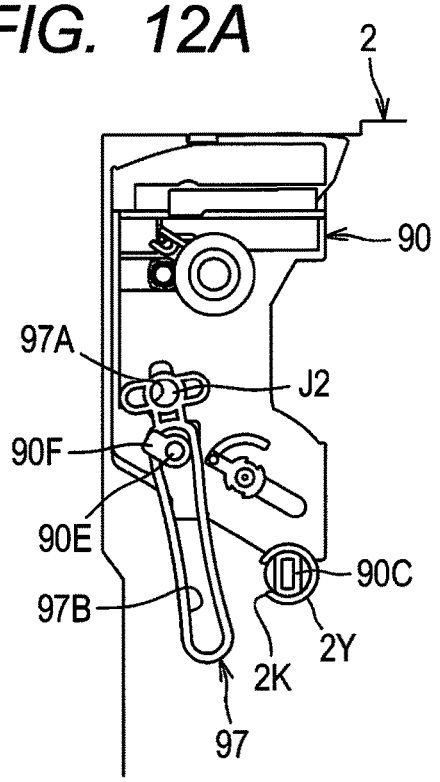
FIG. 12A is a diagram showing the branch frame located at a normal position.
Figure 12B:
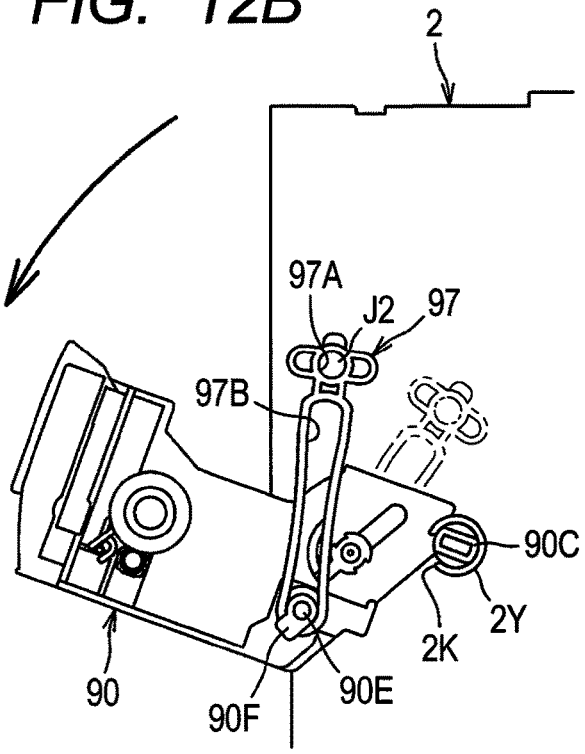
FIG. 12B is a diagram showing the branch frame located at an open position.
Figure 12C:
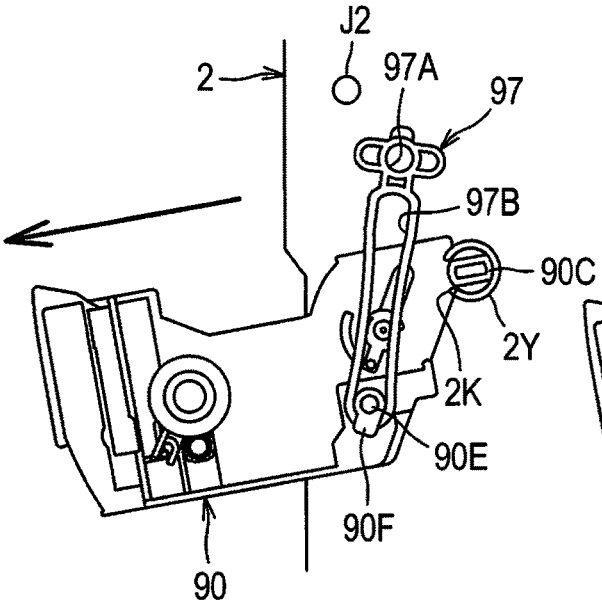
FIG. 12C is a diagram showing the branch frame located at a release position.
Figure 12D:
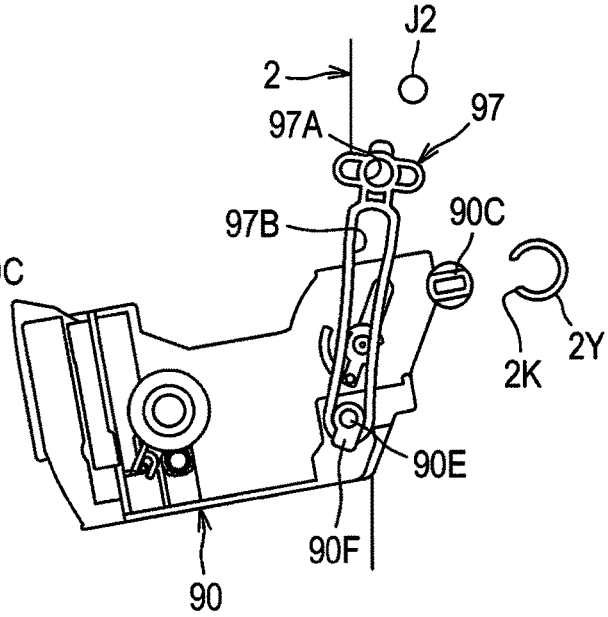
FIG. 12D is a diagram showing the branch frame in a state where the branch frame is detached from the main housing.

The first protrusion 90C is engaged with a bearing 2Y shown in FIG. 12D formed at the main housing 2. The bearing 2Y has a C-shape with an opening 2K. As shown in FIGS. 12A and 12B, when the lengthwise direction of the first protrusion 90C (the direction along the planar portions 90L as viewed from the axial direction) is directed to a different direction from the opening 2K, the bearing 2Y does not separate from the first protrusion 90C but rotatably supports the branch frame 90. As shown in FIGS. 12C and 12D, when the lengthwise direction of the first protrusion 90C is directed to the opening 2K, the first protrusion 90C can separate from the bearing 2Y along the lengthwise direction of the first protrusion 90C. The position of the branch frame 90 in a state where the lengthwise direction of the first protrusion 90C is directed to the opening 2K is referred to as a release position. That is, when the branch frame 90 is located at the release position, the branch frame 90 is detachable from the main housing 2.

The pivotal support mechanism of detachably coupling the lower end of the branch frame 90 to the main housing 2 may be configured such that the branch frame 90 includes a bearing with an opening, and the main housing 2 includes a shaft to be detachably coupled to the bearing.

The second protrusion 90D is a circular columnar protrusion protruding from the branch frame 90 toward the opposite side of the first protrusion 90C. The second protrusion 90D fits in a hole at the main housing 2 (not shown) and is rotatably supported.

The third protrusion 90E is a shaft protruding in the axial direction. The third protrusion 90E has a tip provided with a retaining portion 90F extending in a direction perpendicular to the axial direction.

The branch frame 90 includes a second rotational-movement restricting member 97 that prevents the branch frame 90 from rotationally moving downward farther than the open position. More specifically, the second rotational-movement restricting member 97 prevents the branch frame 90 from rotationally moving to the release position. The second rotational-movement restricting member 97 is provided at an end of the branch frame 90 at one side in the axial direction.

The upper end of the second rotational-movement restricting member 97 is coupled to the main housing 2 through a coupling portion which is attachable and detachable without using a tool. More specifically, the second rotational-movement restricting member 97 includes a hole 97A and an elongated hole 97B. The hole 97A is engaged with a shaft J2 provided so as to protrude inward in the left-right direction from a side frame of the main housing 2. The second rotational-movement restricting member 97 is configured such that, by moving the upper end of the second rotational-movement restricting member 97 inward in the axial direction, the hole 97A separates from the shaft J2.

The elongated hole 97B is provided along the lengthwise direction of the second rotational-movement restricting member 97. The elongated hole 97B is engaged with the third protrusion 90E and supported by the third protrusion 90E in a rotatable and slidable manner. Because the retaining portion 90F is located outside the second rotational-movement restricting member 97 in the axial direction, the third protrusion 90E is prevented from separating from easily from the second rotational-movement restricting member 97. The second rotational-movement restricting member 97 is made of a material having suitable elasticity, and functions as a damper to absorb shock occurring during opening and closing of the branch frame 90.

A procedure taken by an operator for detaching the fixing device 8 from the main housing 2 will be described next by referring to FIGS. 10 to 12D.

Figure 11A:
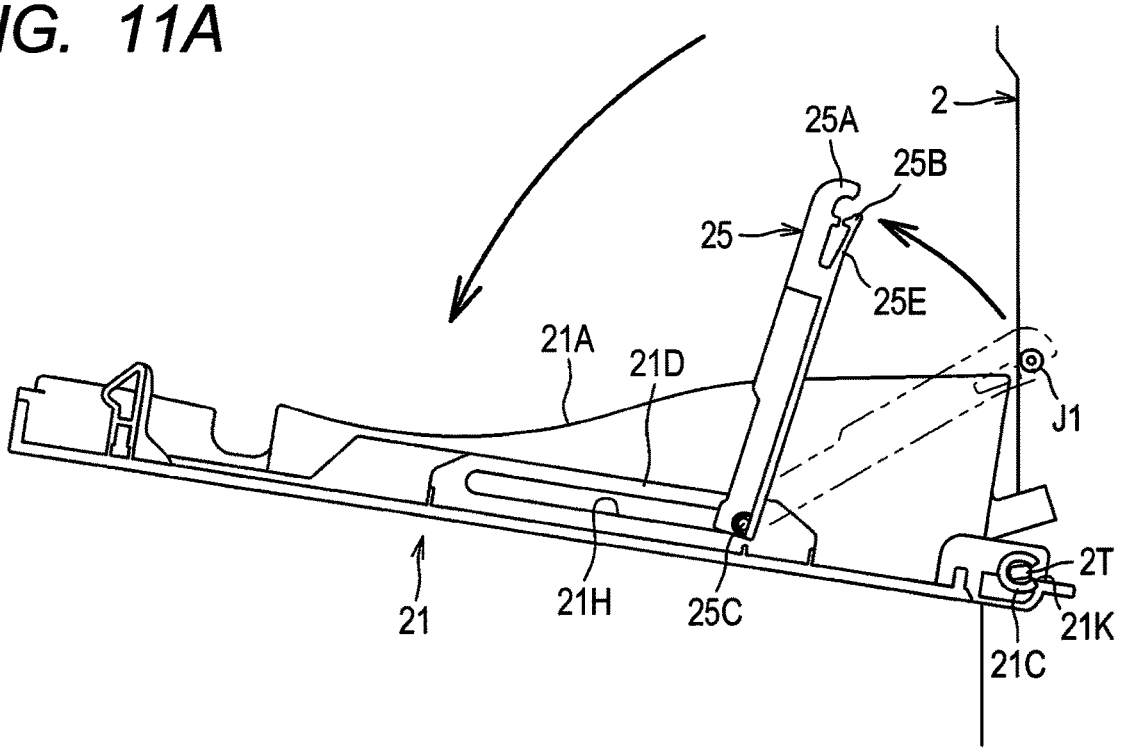
FIG. 11A is a diagram for illustrating a state where the first rotational-movement restricting member is detached from the first cover located at the open position.
Figure 11B:
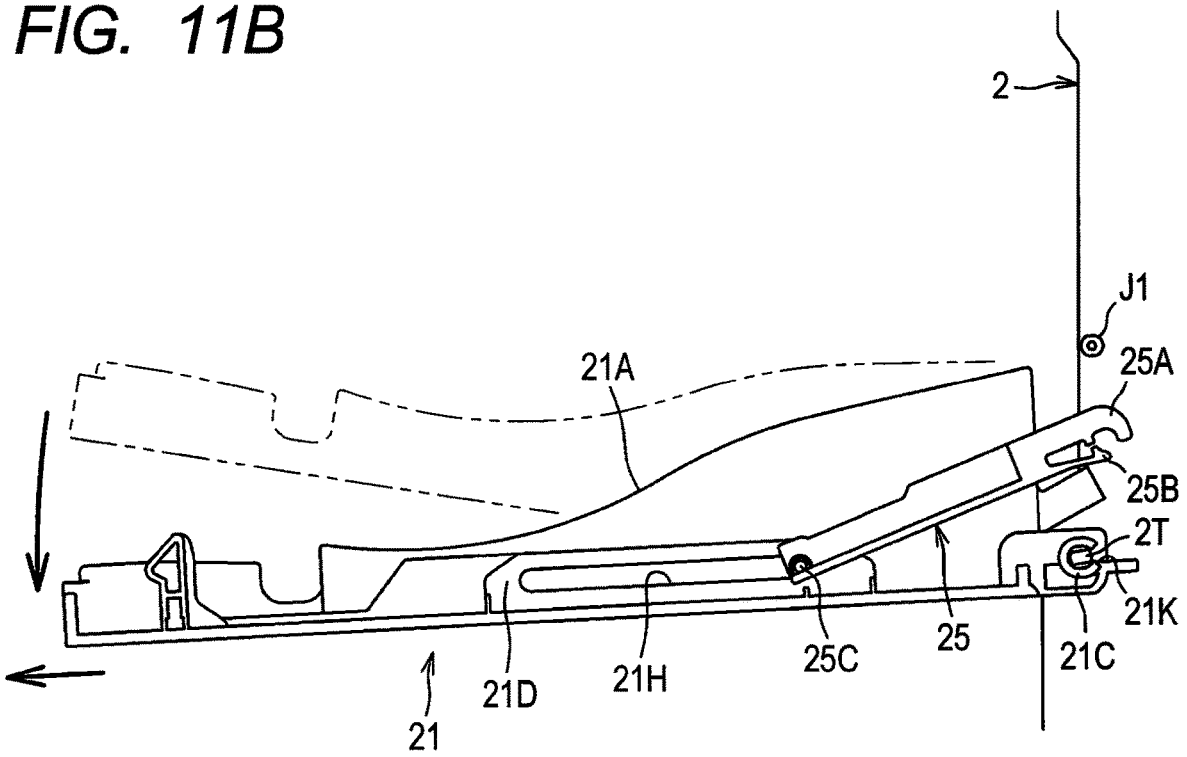
FIG. 11B is a diagram for illustrating a state where the first cover is rotationally moved to the release position and detached from the main housing.

For detaching the fixing device 8, the operator first moves the first cover 21 to the open position (S1, double-dot chain lines in FIG. 11A). When the first cover 21 is located at the open position, the first rotational-movement restricting members 25 provided at both ends of the first cover 21 are exposed. The operator pulls up the first rotational-movement restricting member 25. Then, the arm 25E is deflected and the lock portion 25B moves, thereby causing the shaft J1 to separate from the pivotal support portion 25A (S2, solid lines in FIG. 11A). When the first rotational-movement restricting member 25 is detached from the main housing 2, the first cover 21 is rotationally movable to the release position.

Next, the operator moves the first cover 21 to the release position. As indicated by solid lines in FIG. 11B, when the orientation of the opening 21K of the bearing 21C and the lengthwise direction of the shaft 2T are aligned, the bearing 21C can separate from the shaft 2T easily. Once the bearing 21C separates from the shaft 2T, the shaft 21B at the opposite side of the bearing 21C also can be pulled out easily from a hole at the main housing 2 (not shown). In this way, the operator detaches the first cover 21 from the main housing 2 (S3).

Next, the operator moves the branch frame 90 located at the normal position shown in FIG. 12A to the open position shown in FIG. 12B (S4). Then, the operator moves the upper end of the second rotational-movement restricting member 97 inward in the axial direction. By doing so, the hole 97A of the second rotational-movement restricting member 97 separates from the shaft J2 of the main housing 2 (S5, double-dot chain lines in FIG. 12B). As shown in FIG. 12C, after the hole 97A of the second rotational-movement restricting member 97 separates from the shaft J2 of the main housing 2, the branch frame 90 is rotationally movable to the release position different from the normal position and the open position.

As shown in FIG. 12C, when the branch frame 90 is moved to the release position, the lengthwise direction of the first protrusion 90C of the branch frame 90 and the orientation of the opening 2K of the bearing 2Y are aligned. Thus, the first protrusion 90C can separate from the bearing 2Y easily. After the first protrusion 90C separates from the bearing 2Y, the second protrusion 90D at the opposite side of the first protrusion 90C can also be pulled out easily from a hole at the main housing 2 (not shown). In this way, as shown in FIG. 12D, the operator detaches the branch frame 90 from the main housing 2 (S6).

After the first cover 21 and the branch frame 90 are detached from the main housing 2, the operator detaches the fixing device 8 (S7, FIG. 6). Alternatively, the operator may detach the branch frame 90 before detaching the first cover 21 from the main housing 2. In this case, the procedure from steps S4 to S6 is taken before the procedure from steps S2 to S3. Regarding a procedure for attaching the fixing device 8 to the main housing 2, steps S1 to S7 may be performed in the reversed order.

Based on the above, the following operations and effects can be obtained in the present embodiment.

According to the image forming apparatus 1 described above, in a state where the first cover 21 is located at the open position, the fixing device 8 cannot be attached to and detached from the mount portion 24 through the first opening 2A. In a state where the branch frame 90 is attached to the main housing 2, the fixing device 8 cannot be attached to or detached from the mount portion 24 through the first opening 2A. In a state where the first cover 21 and the branch frame 90 are detached from the main housing 2, the fixing device 8 can be attached to and detached from the mount portion 24 through the first opening 2A. Thus, in the image forming apparatus 1 having the branch frame 90, the fixing device 8 becomes attachable and detachable by detaching the first cover 21 and the branch frame 90 from the main housing 2. Thus, the workability of attaching and detaching the fixing device 8 can be improved.

The first cover 21 is also rotationally movable to the release position different from the closed position and the open position. The first cover 21 is detachable from the main housing 2 when the first cover 21 is located at the release position. That is, unless the first cover 21 is moved to the release position, the first cover 21 cannot be detached from the main housing 2. This suppresses unintentional detachment of the first cover 21.

The first cover 21 further includes the first rotational-movement restricting member 25 that restricts the first cover 21 from rotating to the release position. Thus, the first rotational-movement restricting member 25 suppresses unnecessary rotational movement of the first cover 21 to the release position.

The branch frame 90 is rotationally movable between the normal position and the open position for opening the first path 91 relative to the normal position. Thus, by moving the branch frame 90 to the open position, the user can easily remove the sheet S jammed in the first path 91.

The branch frame 90 is further rotationally movable to the release position different from the normal position and the open position, and is detachable from the main housing 2 when the branch frame 90 is located at the release position. Hence, the branch frame 90 cannot be detached from the main housing 2 unless the branch frame 90 is moved to the release position. This suppresses unintentional detachment of the branch frame 90.

The branch frame 90 further includes the second rotational-movement restricting member 97 that restricts the branch frame 90 from rotationally moving to the release position. The second rotational-movement restricting member 97 suppresses unnecessary rotational movement of the branch frame 90 to the release position.

While the disclosure has been described in detail with reference to the above aspects thereof, it would be apparent to those skilled in the art that various changes and modifications may be made therein without departing from the scope of the claims.

In the above embodiment, the drive lever 110 is exemplified as a member for moving the second flapper FL2, but such member is not limited to this. For example, the member for moving the second flapper may be an electromagnetic solenoid. That is, the second flapper may be configured to be directly moved by an electromagnetic solenoid without using a member such as the drive lever 110 of the above embodiment.

In the above embodiment, the second flapper FL2 swings from the second position to the first position, which is the initial position, due to gravity. Alternatively, for example, the second flapper FL2 may be configured to swing from the second position to the first position due to the urging force of a spring.

In the above embodiment, the second flapper FL2 swingably supported between the first position and the second position is exemplified as the guide member. Alternatively, for example, the guide member may be supported so as to be slidable in the front-rear direction or in the vertical direction between the first position and the second position.

The configuration of the image forming unit 4 described in the above embodiment is one example. For example, the image forming unit may include an exposure device that exposes the photosensitive drum with a plurality of LEDs instead of the exposure device 5. The number of process units may be two, three, five or more, or one, instead of four. For example, in a case where there is one process unit, the transfer unit 7 having the conveyance belt 73 may not be provided, and the process unit may include a transfer roller. In the fixing device 8, a heating member including an endless belt may be provided instead of the heat roller 81. The fixing device 8 may include a pressure roller instead of the pressure member 82.

The image forming apparatus is not limited to a color printer, and may be a monochrome printer, a multifunction peripheral, a copier, and so on. In the above-described embodiment, the electrophotographic-type image forming apparatus is exemplified, but the disclosure is not limited to this. For example, the image forming apparatus may be an inkjet type and so on.

The elements described in the above-described embodiments and modifications may be combined and implemented as appropriate.

What is claimed is:

1. An image forming apparatus comprising:

a main housing having a first opening and a mount portion;

a first cover attachable to and detachable from the main housing, the first cover being rotationally movable between a closed position at which the first cover closes the first opening and an open position at which the first cover opens the first opening;

a print engine configured to form an image on a sheet, a first path, a second path, and a third path being formed in the main housing for performing duplex printing by inverting a front side and a back side of a sheet, the first path guiding a sheet conveyed from the print engine to outside the main housing, the second path branching from the first path and guiding a sheet conveyed from the print engine, the third path connected to the first path and the second path and guiding a sheet on which an image is formed to the print engine again;

a fixing device attachable to and detachable from the mount portion through the first opening; and a branch frame attachable to and detachable from the main housing, at least part of the branch frame being located between the fixing device and the first cover, the branch frame having a first guide surface forming the first path and a second guide surface forming the second path, in a state where the first cover is located at the open position, at least part of the first cover being located in a space through which the fixing device passes when the fixing device is detached from the mount portion, and the fixing device being unattachable to and undetachable from the mount portion through the first opening, in a state where the branch frame is attached to the main housing, at least part of the branch frame being located in the space, and the fixing device being unattachable to and undetachable from the mount portion through the first opening, and in a state where the first cover and the branch frame are detached from the main housing, the fixing device being attachable to and detachable from the mount portion through the first opening.

2. The image forming apparatus according to claim 1, wherein the first cover has a third guide surface forming the second path in a state where the first cover is located at the closed position; and wherein the third guide surface is configured to support a sheet conveyed from the fixing device in a state where the first cover is located at the open position.

3. The image forming apparatus according to claim 1, wherein the first cover is further rotationally movable to a release position different from the closed position and the open position; and wherein the first cover is detachable from the main housing when the first cover is located at the release position.

4. The image forming apparatus according to claim 3, wherein the first cover further includes a first rotational-movement restricting member configured to restrict rotational movement of the first cover to the release position.

5. The image forming apparatus according to claim 1, wherein the branch frame is rotationally movable to a normal position and an open position at which the first path is opened relative to the normal position.

6. The image forming apparatus according to claim 5, wherein the branch frame is further rotationally movable to a release position different from the normal position and the open position; and wherein the branch frame is detachable from the main housing when the branch frame is located at the release position.

7. The image forming apparatus according to claim 6, wherein the branch frame further includes a second rotational-movement restricting member configured to restrict rotational movement of the branch frame to the release position.

8. The image forming apparatus according to claim 1, wherein the fixing device includes a first shaft and a second shaft;

wherein the main housing has a first groove along which the first shaft is slidable and a second groove along which the second shaft is slidable; and wherein, in a state where the fixing device is attached to the main housing, the first shaft contacts an end of the first groove to determine a position of the first shaft, and the second groove engages the second shaft to determine an orientation of the fixing device.

9. The image forming apparatus according to claim 8, wherein the fixing device and the first cover located at the open position overlap each other as viewed from a direction along which the first groove extends.

10. The image forming apparatus according to claim 8, wherein the branch frame is rotationally movable to a normal position and an open position at which the first path is opened relative to the normal position; and wherein the fixing device and the branch frame located at the open position overlap each other as viewed from a direction along which the first groove extends.

11. The image forming apparatus according to claim 1, wherein the branch frame includes a guide member movable between:

a first position at which the guide member guides a sheet conveyed from the print engine to the first path; and a second position at which the guide member guides a sheet conveyed from the print engine to the second path;

wherein the image forming apparatus further includes a drive mechanism configured to move the guide member between the first position and the second position; and wherein the drive mechanism is attached to the main housing.

12. The image forming apparatus according to claim 1, wherein an upper surface of the main housing includes a discharge tray configured to support a sheet conveyed from the first path.

13. The image forming apparatus according to claim 4, wherein the first rotational-movement restricting member has one end and an other end, the one end being detachably coupled to the main housing, the other end being rotatably and slidably coupled to the first cover.

14. The image forming apparatus according to claim 7, wherein the second rotational-movement restricting member has one end and an other end, the one end being detachably coupled to the main housing, the other end being rotatably and slidably coupled to the branch frame.

15. The image forming apparatus according to claim 3, wherein one of the main housing and the first cover includes a bearing having a C-shape with an opening as viewed from an axial direction of a rotational axis of the first cover;

wherein an other one of the main housing and the first cover includes a shaft rotatably supported by the bearing, the shaft having a shape elongated in a lengthwise direction as viewed from the axial direction;

wherein, when the first cover is located at the closed position or the open position, the lengthwise direction of the shaft is not directed to the opening of the bearing and the shaft is undetachable from the bearing; and wherein, when the first cover is located at the release position, the lengthwise direction of the shaft is directed to the opening of the bearing and the shaft is detachable from the bearing.

16. The image forming apparatus according to claim 6, wherein one of the main housing and the branch frame includes a bearing having a C-shape with an opening as viewed from an axial direction of a rotational axis of the branch frame;

wherein an other one of the main housing and the branch frame includes a protrusion rotatably supported by the bearing, the protrusion having a shape elongated in a lengthwise direction as viewed from the axial direction;

wherein, when the branch frame is located at the normal position or the open position, the lengthwise direction of the protrusion is not directed to the opening of the bearing and the protrusion is undetachable from the bearing; and wherein, when the branch frame is located at the release position, the lengthwise direction of the protrusion is directed to the opening of the bearing and the protrusion is detachable from the bearing.

* * * * *